US007676974B2

(12) United States Patent
Zemanek

(10) Patent No.: US 7,676,974 B2
(45) Date of Patent: Mar. 16, 2010

(54) AUTOMATIC RIFLE CONVERTED FOR NON-MILITARY USE

(75) Inventor: Vladimir Zemanek, Hoštálková (CZ)

(73) Assignee: Tomas Quis (CZ)

( * ) Notice: Subject to any disclaimer, the term of this patent is extended or adjusted under 35 U.S.C. 154(b) by 447 days.

(21) Appl. No.: 11/442,324

(22) Filed: May 30, 2006

(65) Prior Publication Data

US 2007/0180748 A1 Aug. 9, 2007

(30) Foreign Application Priority Data

Feb. 9, 2006 (CZ) ..... PV 2006-93

(51) Int. Cl.
*F41A 3/00* (2006.01)

(52) U.S. Cl. ..... 42/69.02; 89/128; 89/140; 89/141; 89/144; 89/145; 89/146; 89/149

(58) Field of Classification Search ..... 89/128, 89/140, 141, 144–146, 149; 42/69.02
See application file for complete search history.

(56) References Cited

U.S. PATENT DOCUMENTS

| | | | | | |
|---|---|---|---|---|---|
| 2,356,257 | A * | 8/1944 | Lowe | 42/75.01 |
| 3,670,442 | A * | 6/1972 | Kennedy et al. | 42/70.08 |
| 3,949,508 | A * | 4/1976 | Elkas | 42/69.03 |
| 4,017,996 | A * | 4/1977 | Liedke | 42/69.03 |
| 4,023,465 | A * | 5/1977 | Inskip | 89/131 |
| 4,056,038 | A * | 11/1977 | Rath | 89/139 |
| 4,057,003 | A * | 11/1977 | Atchisson | 89/138 |
| 5,614,691 | A * | 3/1997 | Taylor | 89/128 |
| 5,697,178 | A * | 12/1997 | Haskell | 42/70.04 |
| 5,726,377 | A * | 3/1998 | Harris et al. | 89/191.01 |
| 5,827,992 | A * | 10/1998 | Harris et al. | 89/191.01 |
| 6,543,169 | B2 * | 4/2003 | Bero | 89/145 |
| 6,625,916 | B1 * | 9/2003 | Dionne | 42/25 |
| 6,634,129 | B1 * | 10/2003 | Freeman, Jr. | 42/69.02 |
| 7,373,868 | B2 * | 5/2008 | Quis | 89/139 |
| 7,398,723 | B1 * | 7/2008 | Blakley | 89/131 |
| 2007/0079696 | A1 * | 4/2007 | Quis | 89/148 |

* cited by examiner

*Primary Examiner*—Michael Carone
*Assistant Examiner*—Jonathan C Weber
(74) *Attorney, Agent, or Firm*—Hershkovitz & Associates, LLC; Abraham Hershkovitz

(57) ABSTRACT

In an automatic rifle which has been converted for non-military purposes to be semi-automatic by the removal of parts that allow its automatic function, additional suppressing elements are provided to ensure that the interruptor remains depressed until the bolt carrier fully passes the striker catch before the striker catch is engaged by the interruptor. This prevents premature connection of the striker catch and the interruptor, which could prevent sufficient striker spring pressure so that the next round can be fired. In one embodiment the trigger mechanism is fitted with an additional suppressing element (10) formed as a side push plate 7 on the bridge (6) of bolt carrier (5). In a second embodiment the interruptor is provided with a pin (8) protruding to the left, in a direction of fire, while the receiver side wall has a cavity (11), over which a thin metal sheet (9) with a beveled corner is placed such that between the lower edge of metal sheet (9) and the lower edge of cavity (11), as well as between rear edge of metal sheet (9) and rear edge of cavity (11) a gap (12) is provided to receive the pin. The additional suppressing element is particularly applicable to a Czech model SA vz.58 semi-automatic rifle which has been converted for non-military purposes.

13 Claims, 10 Drawing Sheets

Prior Art

AUTOMATIC RIFLE CONVERTED FOR NON-MILITARY USE

CROSS-REFERENCE TO RELATED APPLICATIONS

The present application claims priority under 35 U.S.C. §119 of Czech Patent Application No. PV 2006-93, filed on Feb. 9, 2006, the disclosure of which is expressly incorporated by reference herein in its entirety.

BACKGROUND OF THE INVENTION

1. Field of the Invention

The invention relates to an automatic rifle model Sa vz. 58 modified for non-military purposes, where the modification includes, among others, removing some parts of the mechanism that enable fully automatic function. Within this modification, among other parts, one of the two striker catches (sears), is removed. The modification can be used in rifles for civilan and sporting use.

2. Discussion of Background Information

Currently, an interest exists in weapons developed for military purposes, which can be modified for non-military purposes while keeping the original outer appearance. This interest is shared mainly among collectors and other civilians. To satisfy this demand, original fully automatic weapons are modified for sporting purposes, usually in relation to national laws and regulations, mostly by removing parts, which enable fully automatic fire. In the case of Czech automatic rifle Sa vz. 58 the modification consists of, among others, removal of the right hand side striker catch, release lever and right hand side of the trigger mechanism feather. This modification is complemented by other modifications, including those, which prevent the reversed conversion into a rifle allowing fully automatic fire.

However, rifles modified this way to be semi-automatic, tend to exhibit one significant malfunction, which was not observed in original fully automatic rifles. Some shooters experienced that after a shot is fired, the striker is not caught by the striker catch. At the same time the striker is, together with the bolt carrier, moved to a front position so that the striker is not under sufficient pressure from the striker spring so that the next shot can be fired. In order to fire the next round, the gun has to be cocked again manually. Even more confusing about this malfunction is the fact that when shooting the identical rifle, some shooters do not experience this malfunction at all, while other shooters experience it very often.

SUMMARY OF THE INVENTION

According to one aspect of the invention, insufficient retention of the striker is eliminated in rifles modified in a manner described above.

This aspect of the invention is applied in an automatic rifle modified for non-military purposes, where the modification includes, among others, removal of some of the parts of the mechanism that allow fully automatic function of the rifle, most importantly the removal of one of the two striker catches (sears), release lever and one arm of the trigger mechanism feather. The substance of the invention lies in fitting out the trigger mechanism with an additional element for depressing the interrupter.

One of the suitable executions of the additional depressing element of the trigger mechanism is the extension, in the direction of fire, in the form of the side push plate of the bolt carrier's bridge.

Additionally, the depressing element for the trigger mechanism can also be executed as a disconnector pin on the interrupter, sticking out to the left in the direction of fire, while there is a cut-out in the receiver, opposite the pin. A thin metal sheet is placed across the cut-out. Between the lower edge of the metal sheet and lower edge of the cut-out, as well as between the rear edge of the metal sheet and the rear edge of the cut-out, is a gap to receive the pin and constrain its movement, and thereby the movement of the interrupter.

The principle according to one aspect of the invention is to continuously depress the interrupter for the moment of the recoil, i.e. for the moment long enough for the bolt carrier, on its way to the rear position, to pass beyond the striker catch and keep the striker catch in its lower position until the appropriate moment for the interrupter to rise and engage the striker catch.

The invention includes an automatic rifle which has been modified for non-military purposes by removing one of the two striker catches, the release lever and one arm of the trigger mechanism feather, leaving a trigger connected to an interrupter which moves forwardly in the direction of fire and vertically. In its rear upward position the interrupter engages a striker catch. The bolt carrier includes a lower downwardly extending bridge, which during its rearward movement within the receiver of the rifle can engage and depress the interrupter. The additional depressing element is arranged to engage and depress the interrupter over at least that distance of the bolt carrier rearward movement beginning with when the bridge makes contact with the interruptor, to the remainder of said bolt carrier rearward movement.

The additional depressing element can be manifested by a plate attached to the bolt carrier on its left side and extending downwardly from its lower side to the same extent as the bridge, or as a pin extending laterally from the interrupter to the left, when viewed in the direction of fire, which is received in a cavity in the inside wall of the receiver. The thin metal sheet is laid over the cavity on the inside of the receiver and only partially covers the cavity, leaving a rear vertically extending gap and a lower horizontally extending gap which receives and constrains the movement of the pin.

In the embodiment utilizing a pin, the metal sheet is resilient and flexible and includes a bevel at its rear edge over which the pin may ride as the interuptor moves forwardly.

The resulting semi-automatic rifle has a receiver, a bolt carrier mounted for longitudinal movement within the receiver, a striker mounted for longitudinal movement within the receiver against the bias of a striker spring that urges the striker forward in the longitudinal direction of fire. A striker catch is mounted within the receiver and biased to move to an engaged position holding the striker in its rearward, spring biased position.

A trigger is attached to an interrupter that moves forwardly as the trigger is depressed. The interrupter is also capable of moving to an upward position to engage and hold the striker catch. The bridge bears against the interrupter as the bolt carrier moves rearwardly to depress the interrupter, and the additional depressing element ensures the continued depression of the interrupter until the bolt carrier moves fully rearwardly, despite any unintentional premature release followed by continued pull of the trigger.

The method of converting an automatic rifle which has already been modified for non-military purposes includes providing an additional depressing element arranged to engage and depress the interrupter over the complete length of the bolt carrier rearward movement.

The additional depressing element according to one aspect of the invention, is provided by attaching a plate having a height generally equal to the downward extent of the bridge and a length to extend forwardly of the bridge, to the lower side of the bolt carrier, adjacent the bridge and extending forwardly.

The method of converting an automatic rifle which has already been modified for non-military purposes may alternatively include attaching a laterally extending pin to the interrupter, and forming a cavity within the side wall of the receiver to receive the pin.

A thin metal sheet is placed over the cavity on the inner side of the cavity and only partially covering the cavity. This leaves a rear vertically extending gap and a lower horizontally extending gap, to receive and constrain the movement of the pin.

The sheet metal is resilient and flexible and formed with a bevel at its rear edge over which the pin may ride as the interuptor moves forwardly.

A rifle is modified according to one aspect of the invention for non-military purposes by removing one of the two striker catches, the release lever and one arm of the trigger mechanism feather, leaving a trigger connected to an interrupter which moves forwardly in the direction of fire and vertically, and in its rear upward position engages a striker catch, a bolt carrier including a lower downwardly extending bridge, which during its rearward movement within the receiver of the rifle can engage and depress the interrupter. The rifle comprises an additional depressing element arranged to engage and depress the interrupter over the complete length of the bolt carrier rearward movement.

The modified rifle according to other aspects of the invention includes a rifle which is a Czech Sa vz .58 model. The additional depressing element may be a plate attached to the bolt carrier and extending downwardly from its lower side. The plate may extend downwardly to the same extent as the bridge. The plate may extend from the bridge forwardly in the direction of fire. The plate may be a side push plate arranged on the left side of the bolt carrier, when viewed in the direction of fire. The additional depressing element may include a pin extending laterally from the interrupter, and wherein the side wall of the receiver may include a cavity to receive the pin. The modified semi-automatic rifle may further include a thin metal sheet laid over the cavity on the inside of the receiver. The metal sheet may cover the cavity partially, leaving a rear vertically extending gap and a lower horizontally extending gap, the gap receiving and constraining the movement of the pin. The metal sheet may be resilient and flexible and may include a bevel at its rear edge over which the pin may ride as the interuptor moves forwardly. The pin may extend laterally to the left as viewed in the direction of fire.

According to another aspect of the invention, a semi-automatic rifle comprises a receiver, a bolt carrier mounted for longitudinal movement within the receiver, a striker mounted for longitudinal movement within the receiver against the bias of a striker spring urging the striker forward in the longitudinal direction of fire, a striker catch mounted within the receiver and biased to move to an engaged position holding the striker in its rearward, spring biased position, a trigger, an interrupter attached to the trigger and arranged to move forwardly as the trigger is depressed, the interrupter also being capable of moving to an upward position within the receiver, the striker catch being held in the engaged position by cooperation with the interrupter, when in its upward position, the bolt carrier including a downwardly extending bridge which bears against the interrupter as the bolt carrier moves rearwardly to depress the interrupter, and an additional depressing element to ensure the continued depression of the interrupter until the bolt carrier moves fully rearwardly, despite any unintentional premature release followed by continued pull of the trigger.

According to further aspects of the invention, the additional depressing element may be a plate attached to the bolt carrier and extending downwardly from its lower side. The plate may extend downwardly to the same extent as the bridge. The plate may extend from the bridge forwardly in the direction of fire. The plate may be a side push plate arranged on the left side of the bolt carrier, when viewed in the direction of fire. The additional depressing element may be provided by a pin extending laterally from the interrupter, and wherein the side wall of the receiver includes a cavity to receive the pin. A thin metal sheet may be laid over the cavity on the inside of the receiver. The metal sheet may cover the cavity partially, leaving a rear vertically extending gap and a lower horizontally extending gap, the gap receiving and constraining the movement of the pin. The metal sheet may be resilient and flexible and includes a bevel at its rear edge over which the pin may ride as the interuptor moves forwardly. The pin may extend laterally to the left as viewed in the direction of fire.

According to yet another aspect of invention, a bolt carrier extends longitudinally in the fire direction and includes a downwardly extending bridge on its rear lower surface, and a side plate attached on the lower side of the bolt carrier adjacent the bridge and extending forwardly, the side plate extending downwardly beneath the bolt carrier to generally the same extent as the bridge.

A firearm according to a further aspect of the invention, has a receiver and an interrupter within the receiver, the interrupter being actuated for forward movement by a trigger and capable of upward movement to cooperate with a striker catch, and a pin extending laterally from the interrupter, wherein the side wall of the receiver includes a cavity to receive the pin.

According to further aspects of the invention, a firearm further includes a thin metal sheet laid over the cavity on the inside of the receiver. The metal sheet may cover the cavity partially, leaving a rear vertically extending gap and a lower horizontally extending gap, the gap receiving and constraining the movement of the pin. The metal sheet may be resilient and flexible and may include a bevel at its rear edge over which the pin may ride as the interuptor moves forwardly.

According to a further aspect of the invention, a method for converting an automatic rifle which has been modified for non-military purposes by removing one of the two striker catches, the release lever and one arm of the trigger mechanism feather, leaving a trigger connected to an interrupter which moves forwardly in the direction of fire and vertically, and in its rear upward position engages a striker catch, a bolt carrier including a lower downwardly extending bridge, which during its rearward movement within the receiver of the rifle can engage and depress the interrupter, providing an additional depressing element arranged to engage and depress the interrupter over at least that distance of the bolt carrier rearward movement beginning with when the bridge makes contact with the interruptor, to the remainder of said bolt carrier rearward movement.

According to further aspects of the invention, the additional depressing element may be provided by forming a side push plate with a height generally equal to the downward extent of the bridge and with a length to extend forwardly of the bridge, and attaching the side push plate to the lower side of the bolt carrier, adjacent the bridge and extending forwardly. The additional depressing element may be provided by attaching a laterally extending pin to the interrupter, and forming a cavity within the side wall of the receiver to receive the pin. The method may further include placing a thin metal sheet over the cavity on the inside of the cavity and partially covering the cavity by the metal sheet so as to leave a rear vertically extending gap and a lower horizontally extending gap, the gap receiving and constraining the movement of the pin. The method may include providing the metal sheet with a bevel at its rear edge over which the pin may ride as the interuptor moves forwardly. The modified rifle may be a Czech Sa vz .58 model.

Other exemplary embodiments and advantages of the present invention may be ascertained by reviewing the present disclosure and the accompanying drawings.

BRIEF DESCRIPTION OF THE DRAWINGS

The present invention is further described in the detailed description which follows, in reference to the noted plurality of drawings by way of non-limiting examples of embodiments of the present invention, in which like reference numerals represent similar parts throughout the several views of the drawings, and wherein.

DETAILED DESCRIPTION OF THE PRESENT INVENTION

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

Figure 1:
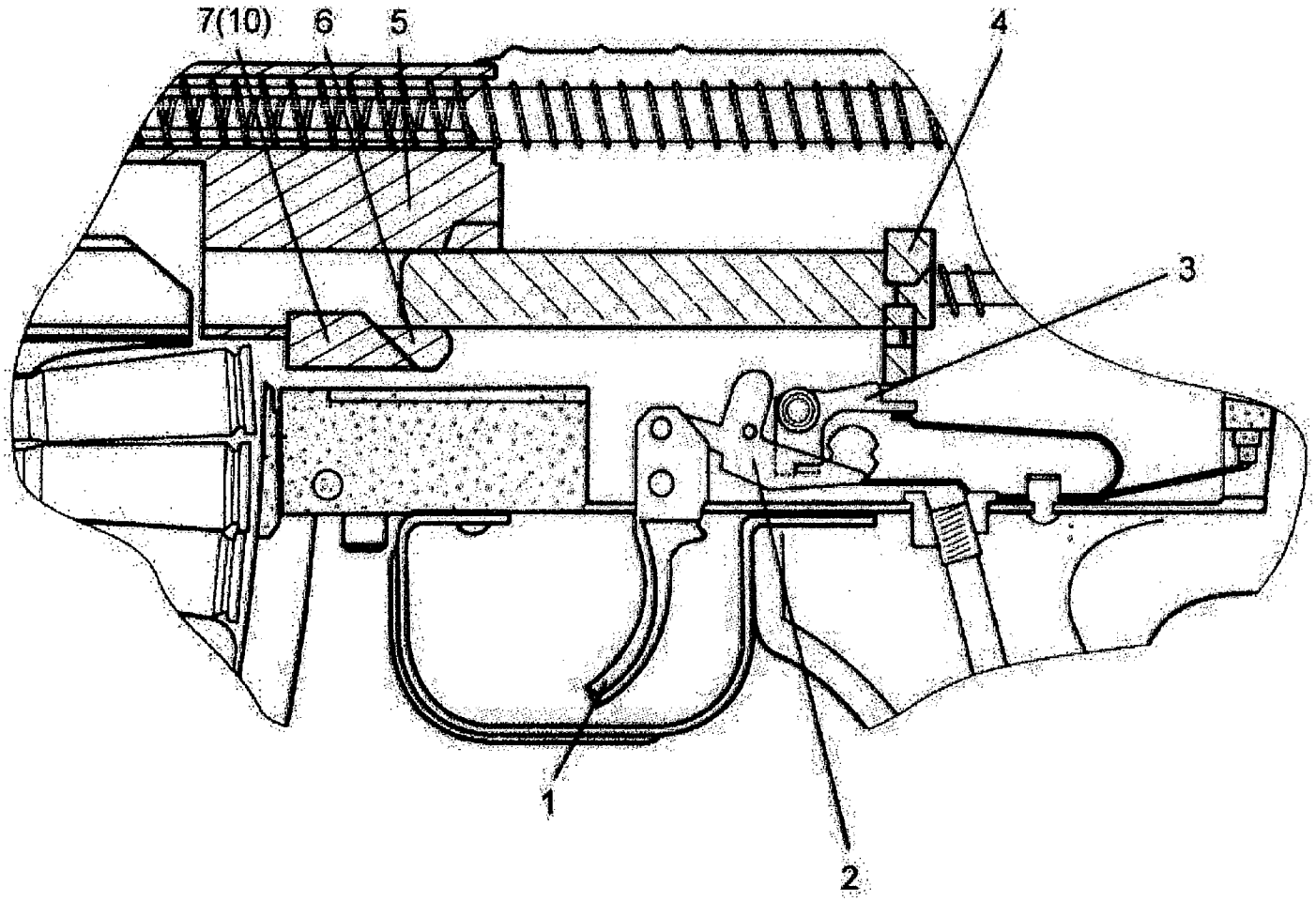
FIG. 1 is a partial side view of a semi-automatic rifle with released trigger and striker under the pressure of the striker spring and retained by the striker catch.
Figure 2:
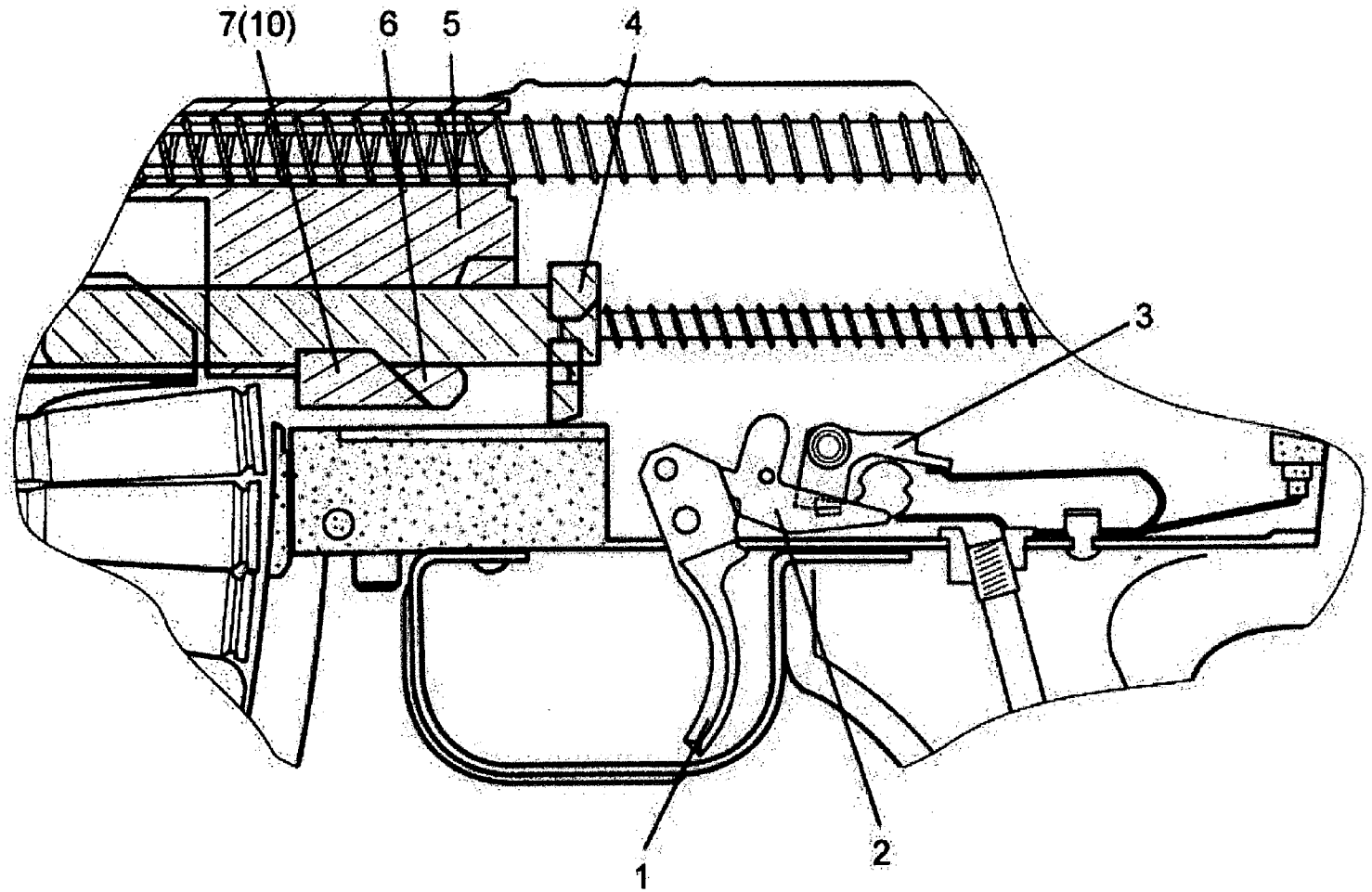
FIG. 2 is a partial side view of the semi-automatic rifle with the trigger pulled and the striker in its front position at the moment of contact with the firing pin.
Figure 3:
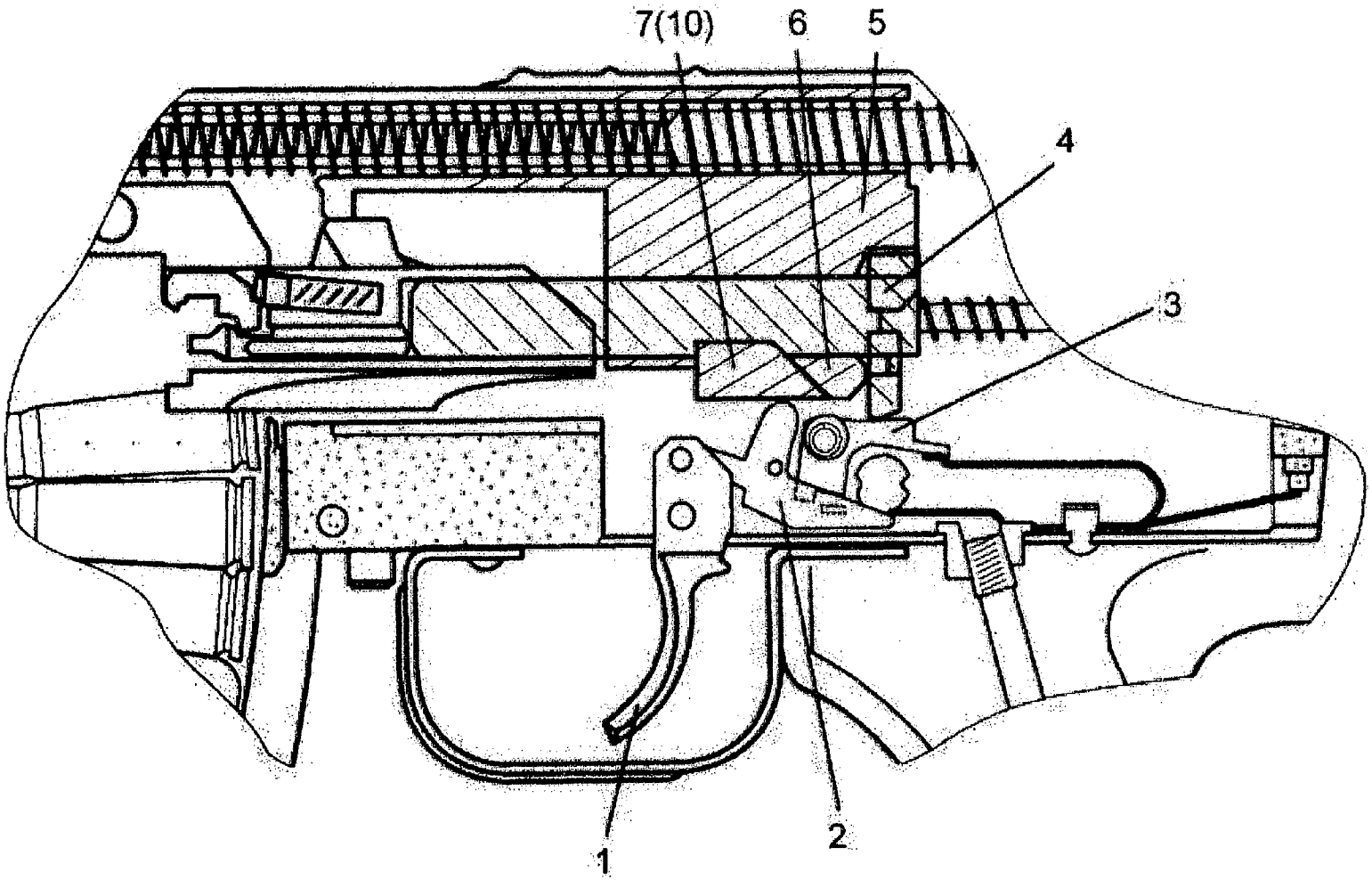
FIG. 3 is a side view of the semi-automatic rifle at the moment of depression of the interrupter by a side push plate of the bolt carrier.

In the attached drawings, particularly FIGS. 1 to 3, parts of the trigger mechanism, mainly trigger 1, with interuptor 2 and striker catch 3 of the striker 4, are shown. The part of the bolt, which is affected by the present invention is mainly the bolt carrier 5.

After many trials, it was discovered, that malfunction occurs mostly with shooters who pull the trigger 1 in a way used in target pistol shooting, i.e. slowly and evenly. At the moment of the firing, recoil forces throw the rifle backwards. The finger on the trigger 1 makes a slow movement, practically without any momentum forces, so that in consequence of the law of action and reaction, during the recoil, the finger slightly releases the trigger 1, which enables the interrupter 2 to move backwards. At that very moment, the bolt carrier 5 passes above the striker catch 3 of the striker 4 and pushes it down. This causes unwanted premature connection of interrupter 2 with striker catch 3. Immediately after that, with recoil forces fading away, pulling of the trigger 1 by the shooter continues and consequent lowering of the striker catch 3 occurs and thus the striker 4 is not retained. Striker 4 is then moved forward together with bolt carrier 5, without sufficient pressure of the striker spring. With shooters who pull the trigger strongly and fast, the said malfunction doesn't occur, because due to momentum forces in the motion of the finger, trigger 1 is not released during the recoil to the extent that it would have a significant effect on the position of the trigger 1 and therefore on the position of the interrupter 2. Premature connection between interrupter 2 and striker catch 3 therefore doesn't happen.

Figure 4:
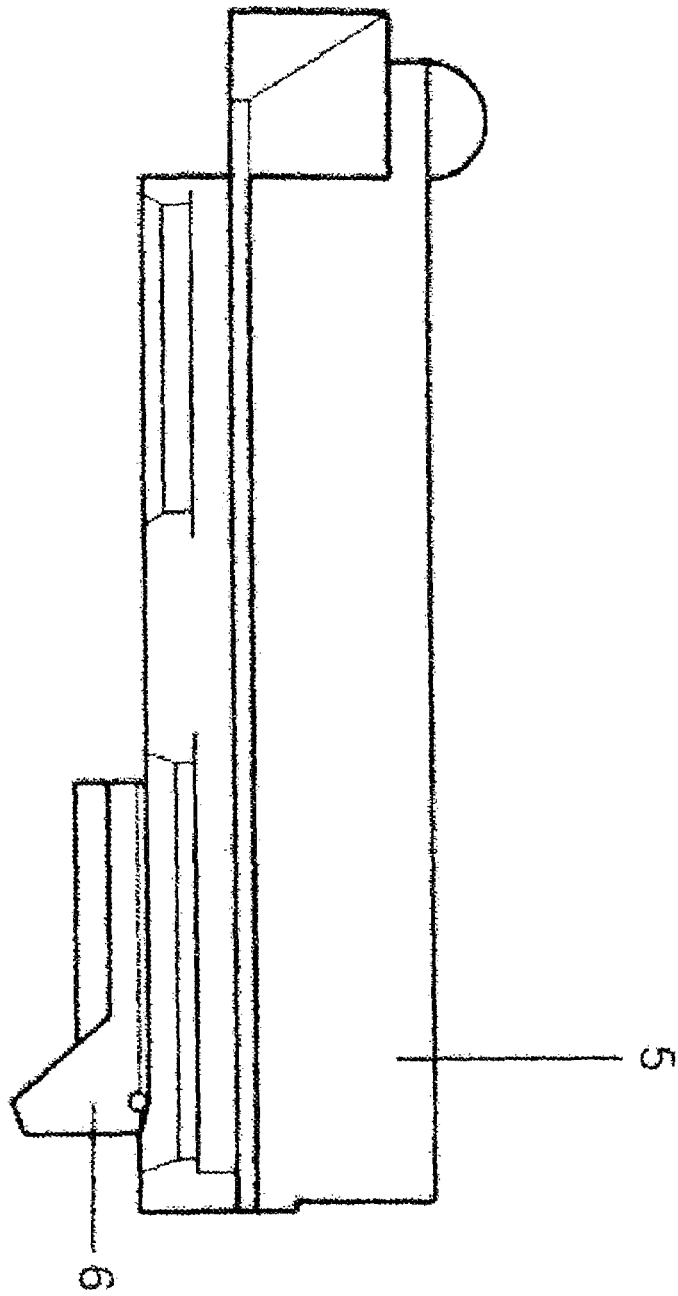
FIG. 4 is a side view of the original bolt carrier with bridge of the prior art.
Figure 5:
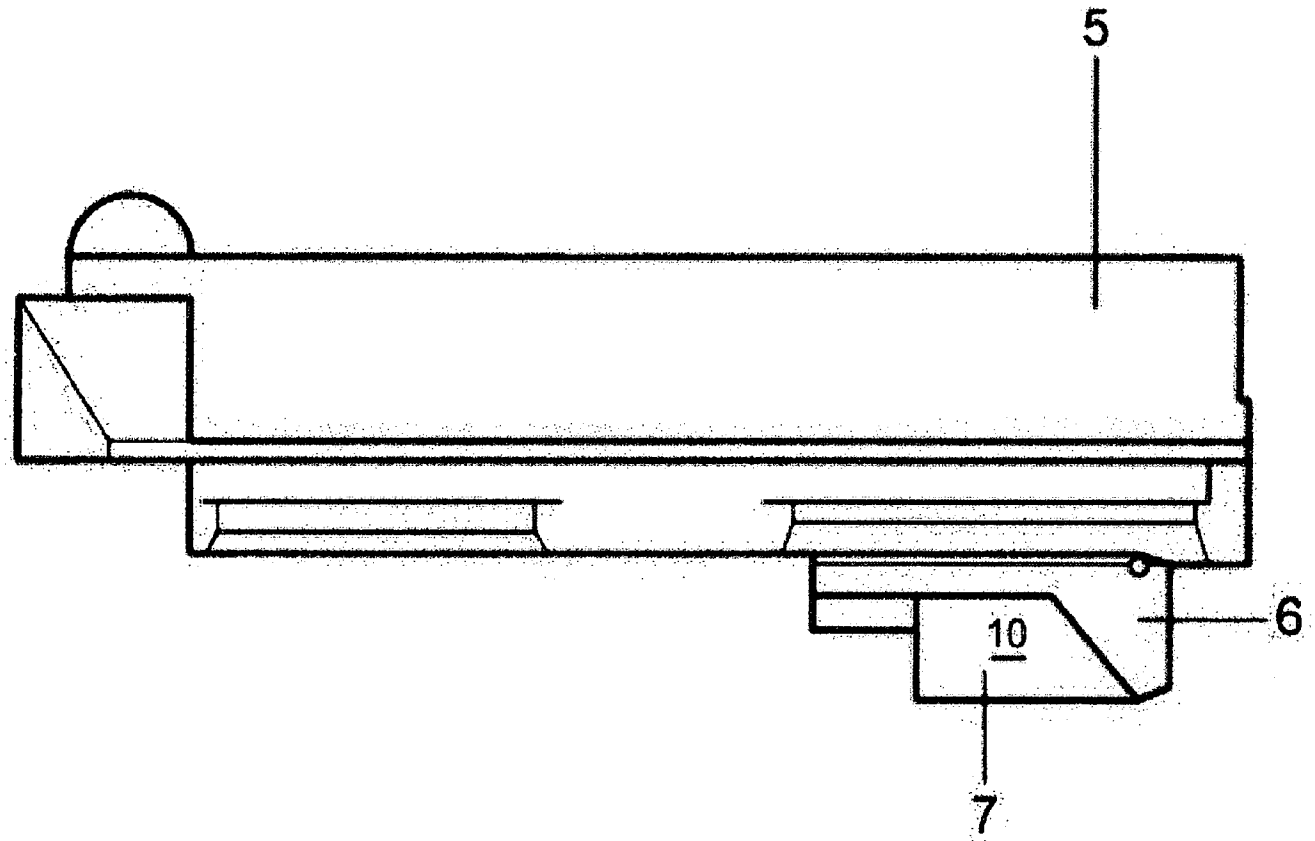
FIG. 5 is a side view of the modified bolt carrier according to the invention with the bridge extended into a form of a side push plate.
Figure 6:
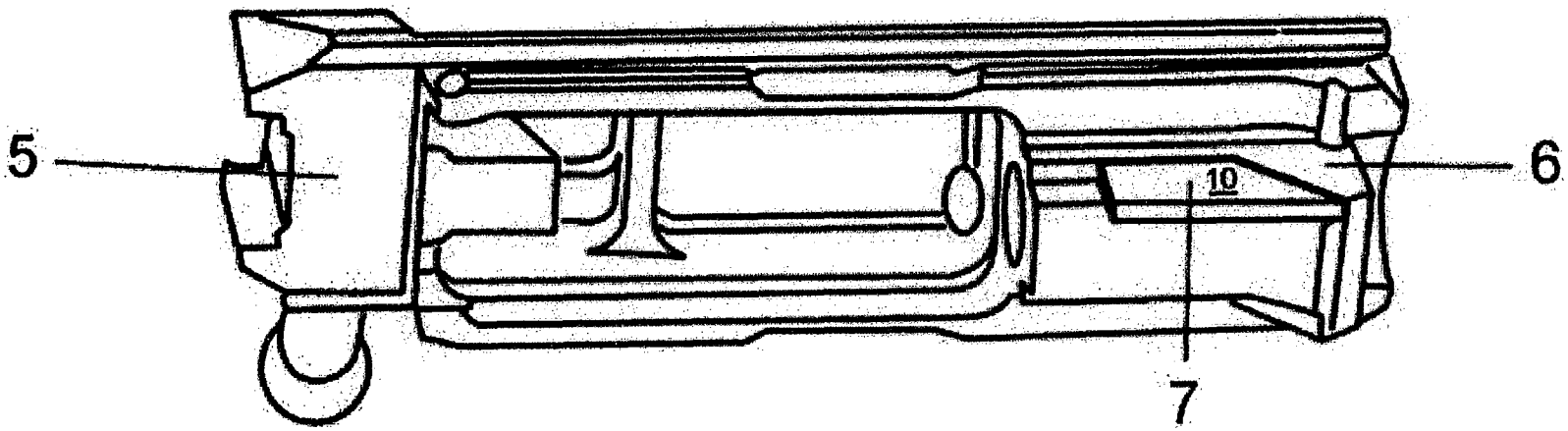
FIG. 6 is a perspective view from beneath of the modified bolt carrier of FIG. 5.

In a first embodiment of the invention shown in FIG. 4, bolt carrier 5 is fitted at its bottom with a bridge 6, which while moving backwards pushes down, at a certain moment, interrupter 2. As shown in FIG. 5 and FIG. 6, bridge 6 is extended in the direction of fire by side push plate 7 . Side push plate 7 is one example of an additional depressing element 10.

The principle of functioning of the particular parts of the converted semi-automatic rifle according to the first embodiment follows.

With bolt carrier 5 modified to include the side push plate 7, interrupter 2 is held down for a long enough time period even when shooting with light, target shooting like pull of the trigger 1. Because the interrupter 2 is, at the moment of the climax of recoil forces, still being pushed down by side push plate 7 and slight, accidental release of the trigger 1 has no affect on the vertical position of interrupter 2, no premature connection between striker catch 3 and interrupter 2 can happen and the movement of the striker 4 into its front position is correctly stopped by elevated striker catch 3.

Figure 7:
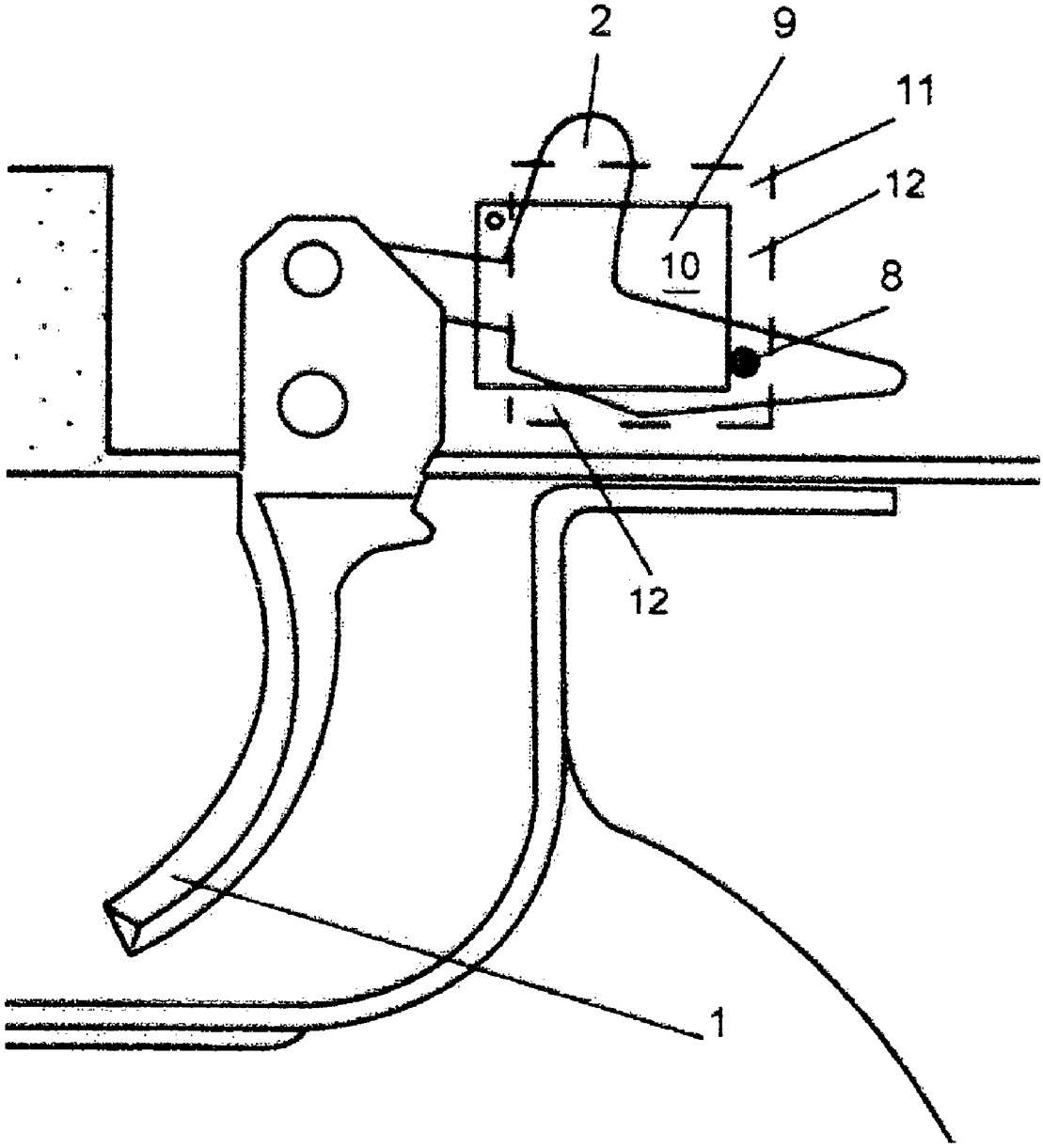
FIG. 7 is a partial side view, similar to FIG. 2, of a second embodiment.
Figure 8:
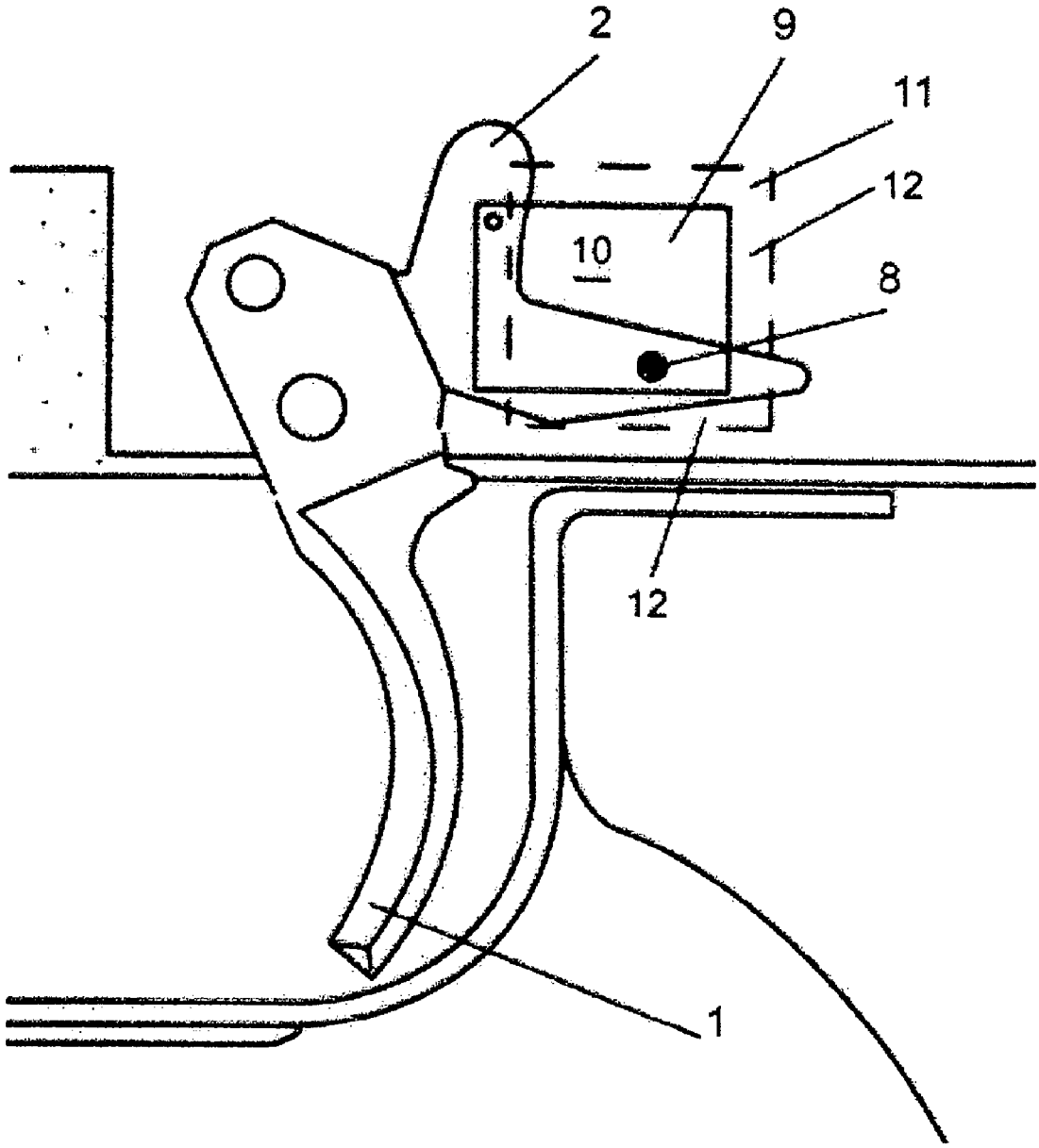
FIG. 8 is a side view of the embodiment of FIG. 7 at the moment of fire.

FIGS. 7 through 10 show another example of execution of additional depressing element 10. In this example interrupter 2 is fitted with a pin 8 which is protruding to the left in the direction of the fire and the left sidewall of the receiver is formed with a cavity 11 as shown in FIG. 7. Over this cavity a small resiliently flexible metal sheet 9 with a beveled rear lower corner is placed in a such way that lower and rear edge of the sheet-metal 9 does not reach to the edge of lower and rear edge of the cavity 11. In other words, between lower edge of metal sheet 9 and lower edge of the cavity 11, as well as between rear edge of sheet-metal 9 and rear edge of the cavity 11 is a gap 12.

The principle of functioning of parts according to the second embodiment is as follows.

Figure 9:
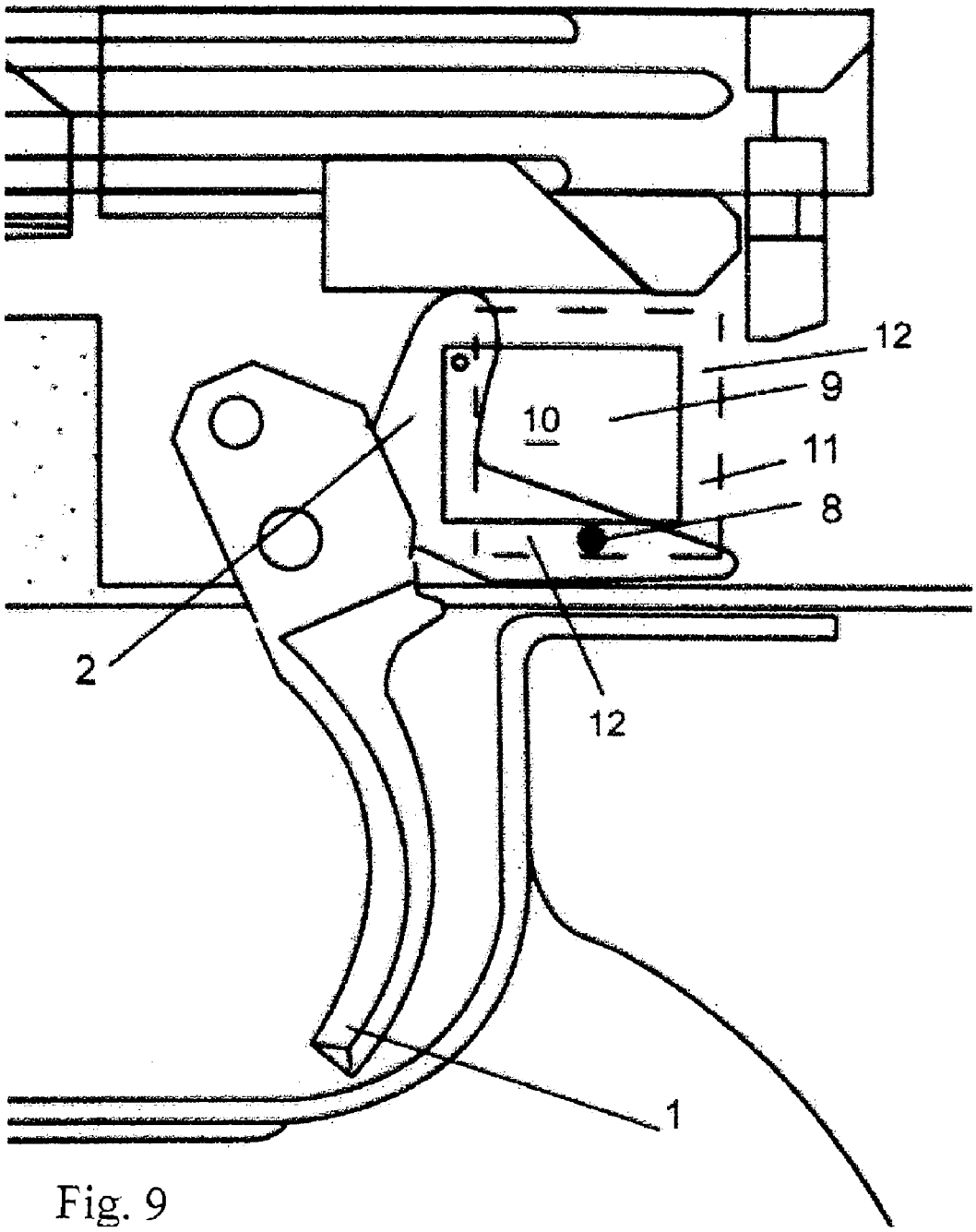
FIG. 9 is a side view of the embodiment of FIG. 7 immediately after the fire.
Figure 10:
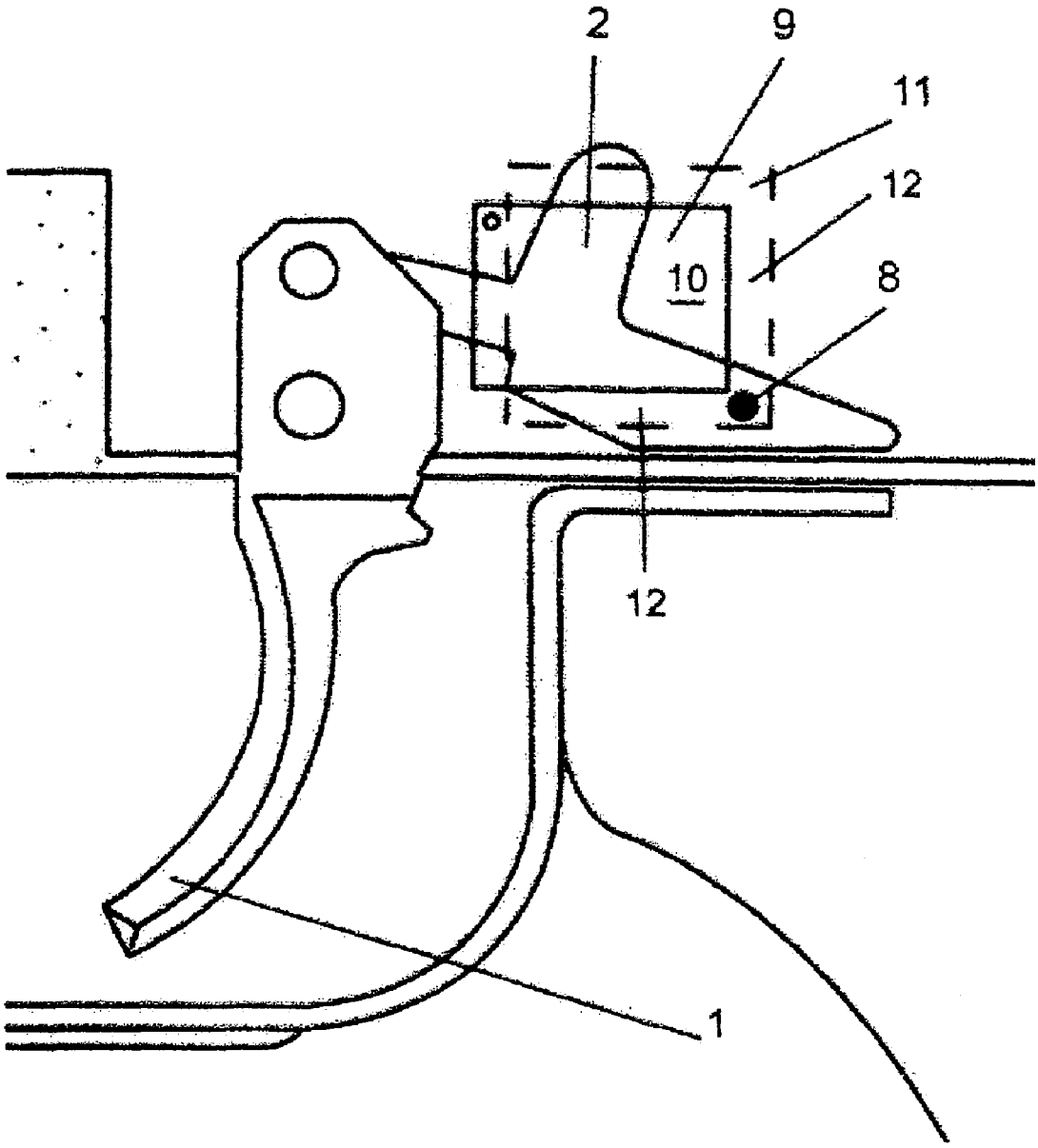
FIG. 10 is a side view of the embodiment of FIG. 7 after the release of the trigger.

When trigger 1 is being pulled (FIG. 8), the pin 8 has passed forwardly over the beveled lower corner and is pushing against metal sheet 9, and together with interrupter 2 is moving forward. At the moment, when after release of striker 4 a round is fired and bolt carrier 5 moves backwards, the interrupter 2 is pushed down by bridge 6 of bolt carrier 5 and pin 8 of interrupter 2 falls into the gap 12 between lower edge of sheet-metal 9 and lower edge of the cavity 11 (FIG. 9). When releasing the trigger 1, interrupter 2 is moving backwards, but is still being held down by pin 8 which is being guided in gap 12 . Pin 8 in gap 12 is thus holding interrupter 2 out of the contact with bridge 6 of bolt carrier 5 so premature connection of the striker catch 3 and interrupter 2 can not happen until the moment of full and complete release of the trigger 1. Cavity 11 and sheet-metal 9 are big enough and therefore also the trajectory for which the interrupter 2 is held down by pin 8 in gap 12 is sufficiently long to prevent pin 8 jumping out from the lower part of gap 12 into the rear part of the gap 12, and thus elevating interrupter 2, even if the trigger 1 is partly released.

The above described embodiments are exemplary and not the only possible applications of the invention. The additional depressing element 10 can have different forms, but it must always apply pressure on interrupter 2 while the recoil forces last.

It is noted that the foregoing examples have been provided merely for the purpose of explanation and are in no way to be construed as limiting of the present invention. While the present invention has been described with reference to an exemplary embodiment, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

What is claimed is:

1. In an automatic rifle which has been modified for non-military purposes by removing one of two striker catches, a release lever and one arm of a trigger mechanism feather, leaving a trigger connected to an interruptor which moves forwardly in a direction of fire and vertically, and in its rear upward position engages a striker catch, a bolt carrier including a lower downwardly extending bridge, which during its rearward movement within the receiver of the rifle is adapted to engage and depress the interruptor, the improvement comprising:

an additional depressing element arranged to engage and depress the interruptor over at least that distance of the bolt carrier rearward movement beginning with when the bridge makes contact with the interruptor, to the remainder of said bolt carrier rearward movement wherein said additional depressing element is a plate attached to the bolt carrier and extends downwardly from its lower side.

2. The modified automatic rifle of claim 1, wherein the rifle is a Czech Sa vz .58 model.

3. The modified automatic rifle of claim 1, wherein the plate extends downwardly to the same extent as the bridge.

4. The modified automatic rifle of claim 1, wherein said plate extends from the bridge forwardly in the direction of fire.

5. The modified automatic rifle of claim 1, wherein said plate is a side push plate arranged on the left side of the bolt carrier, when viewed in the direction of fire.

6. A semi-automatic rifle comprising:

a receiver;

a bolt carrier mounted for longitudinal movement within said receiver;

a striker mounted for longitudinal movement within said receiver against the bias of a striker spring urging the striker forward in the longitudinal direction of fire;

a striker catch mounted within said receiver and biased to move to an engaged position holding the striker in its rearward, spring biased position;

a trigger;

an interruptor attached to said trigger and arranged to move forwardly as said trigger is depressed, said interruptor also being capable of moving to an upward position within said receiver;

said striker catch being held in said engaged position by cooperation with the interruptor, when in its upward position;

said bolt carrier including a downwardly extending bridge which bears against said interruptor as the bolt carrier moves rearwardly to depress the interruptor; and an additional depressing element to ensure the continued depression of the interruptor until the bolt carrier moves fully rearwardly despite any unintentional premature release followed by continued pull of the trigger, wherein said additional depressing element is a plate attached to the bolt carrier and extends downwardly from its lower side.

7. The semi-automatic rifle according to claim 6, wherein said plate extends downwardly to the same extent as the bridge.

8. The semi-automatic rifle according to claim 6, wherein said plate extends from the bridge forwardly in the direction of fire.

9. The semi-automatic rifle according to claim 6, wherein said plate is a side push plate arranged on the left side of the bolt carrier, when viewed in the direction of fire.

10. A bolt carrier for a firearm, the bolt carrier extending longitudinally in the fire direction and including a downwardly extending bridge on its rear lower surface, and a side plate attached on the lower side of the bolt carrier adjacent the bridge and extending forwardly, said side plate extending downwarly beneath the bolt carrier to generally the same extent as the bridge.

11. A method of converting an automatic rifle which has been modified for non-military purposes by removing one of two striker catches, a release lever and one arm of a trigger mechanism feather, leaving a trigger connected to an interruptor which moves forwardly in the direction of fire and vertically, and in its rear upward position engages a striker catch, a bolt carrier including a lower downwardly extending bridge, which during its rearward movement within the receiver of the rifle may engage and depress the interruptor, and wherein the conversion includes:

providing an additional depressing element arranged to engage and depress the interruptor over at least that distance of the bolt carrier rearward movement beginning with when the bridge makes contact with the interruptor, to the remainder of said bolt carrier rearward movement, wherein the additional depressing element is provided by:

forming a side push plate with a height generally equal to the downward extent of the bridge and with a length to extend forwardly of the bridge;

attaching said side push plate to the lower side of the bolt carrier, adjacent the bridge and extending forwardly.

12. The method of converting a modified rifle as in claim 11, wherein the modified rifle is a Czech Sa vz .58 model.

13. A bolt carrier for an automatic rifle which has been modified for non-military purposes, the bolt carrier comprising:

a lower side;

a lower downwardly extending bridge, which during its rearward movement within a receiver of the rifle is adapted to engage and depress an interruptor; and an additional depressing element arranged to engage and depress the interruptor at least that distance of the bolt carrier rearward movement in the rifle beginning with when the bridge makes contact with the interruptor, to the remainder of said bolt carrier rearward movement, wherein said additional depressing element is a plate attached to the bolt carrier and extending downwardly from the lower side of the bolt carrier.

* * * * *